United States Patent [19]

Sandvik et al.

[11] 4,087,345

[45] May 2, 1978

[54] POTSHELL FOR ELECTROLYTIC ALUMINUM REDUCTION CELL

[75] Inventors: Eystein Edmund Sandvik; Otto Johannes Strömme, both of Ardalstangen, Norway

[73] Assignee: Ardal og Sunndal Verk a.s., Oslo, Norway

[21] Appl. No.: 817,017

[22] Filed: Jul. 19, 1977

[51] Int. Cl.[2] ..... C25C 3/10; C25C 7/00

[52] U.S. Cl. ..... 204/243 R; 204/274

[58] Field of Search ..... 204/67, 243 R–247, 204/274

[56] References Cited

U.S. PATENT DOCUMENTS

| | | | |
|---|---|---|---|
| 3,421,995 | 1/1969 | Morel et al. | 204/243 R X |
| 3,607,685 | 9/1971 | Johnson | 204/243 R X |
| 3,702,815 | 11/1972 | Nikiforov et al. | 204/243 R |

*Primary Examiner*—John H. Mack
*Assistant Examiner*—D. R. Valentine
*Attorney, Agent, or Firm*—Wenderoth, Lind & Ponack

[57] ABSTRACT

A potshell for an electrolytic cell for the electrolytic reduction of aluminum includes a bottom plate, side walls and end walls of steel plates, and also a reinforcing structure surrounding structure. Up against the side walls and end walls, on the outside thereof are disposed vertical stiffeners and outside these stiffeners there is disposed an essentially horizontal reinforcing frame in such a manner that between the stiffeners there are formed vertical, free air passages up against the side walls and the end walls, and in such a manner that the stiffeners act as cooling ribs for conducting and dissipiating the heat from the side walls and the end walls.

9 Claims, 3 Drawing Figures

POTSHELL FOR ELECTROLYTIC ALUMINUM REDUCTION CELL

BACKGROUND OF THE INVENTION

This invention relates to a potshell for an electolytic cell for the electrolytic reduction of aluminum, the potshell including a bottom plate, side walls and end walls of steel plates, and such elements being surrounded by a reinforcing structure.

Experience has shown that in electrolytic cells, or pots, which are operated at high amperages, electromagnetic forces are produced which can disturb operations. These disturbances usually start to appear around currents of 40–50 kA. When even higher currents are used, for example 100–200 kA, the difficulties can become so great that it is impossible to achieve satisfactory operational conditions unless certain, and usually costly, design provisions are made. These electromagnetic forces occur when the current passes through magnetic fields in the electrolytic cell, and they cause waves, bubbles and other movements in the bath and the metal. As the difference in the specific gravity of the molten bath and the underlying molten metal is very small, this can result in considerable variations in the distance between the anode and the molten metal. To prevent the molten metal from touching the anode, thus causing a partial short circuit, the distance between the anode and the cathode has to be increased. This results in a larger voltage drop between the anode and the cathode, hotter pot operation, and higher power consumption for each kilogram of metal produced.

Horizontal electric currents in the metal pad, in conjunction with the vertical magnetic fields, give rise to electromagnetic forces in the longitudinal direction of the pot. To limit the horizontal current components, and thus reduce the most powerful movements in the metal and bath, it is usual practice to arrange for there to be formed an internal coating of frozen bath along the carbon side lining of the pot. This coating, or side freeze, has an electrical insulating effect, and thus limits the horizontal current components. This side freeze is produced by not making the side lining too thick and by not having any thermal insulation between the side lining and the steel shell of the pot. A further advantage of the side freeze is that it protects the side lining from attack by the bath. Nevertheless, it frequently occurs that the molten material penetrates through the side linings with highly adverse consequences and heavy costs. This penetration of the side lining is primarily caused by high operating temperatures, either in connection with the anode effect or on account of poor operating conditions which can by partly due to powerful electromagnetic forces.

SUMMARY OF THE INVENTION

The object of the present invention is to furnish a strong and stable side freeze, whilst at the same time it becomes possible to build a stronger and more durable potshell without increasing the amount of steel used. This is achieved, according to the invention, in that up against the exteriors of the side walls and the end walls there are disposed vertical stiffeners, and in that outside these stiffeners there is disposed an essentially horizontal, reinforcing frame, in such a manner that between the stiffeners there are formed vertical, free air passages up against the side walls and the end walls, and in such a manner that the stiffeners act as cooling ribs conducting and dissipating the heat from the side walls and the end walls.

The advantages gained through this arrangement are primarily:

1. Placing the reinforcing frame clear of the potshell sides:
   - results in only small thermal stresses in the reinforcing frame, thus avoiding the aging phenomena in the load-bearing structures,
   - results in the temperature of the reinforcing frame remaining low and with only small temperature variations as the ambient temperature varies,
   - results in only small temperature difference between the inside and the outside parts of the reinforcing frame,
   - guides the air current in towards the sides of the potshell.
2. Vertical stiffeners in contact with the sides of the potshell:
   - act as cooling ribs,
   - offer little air resistance,
   - guide the air vertically up along the sides of the potshell,
   - prevent accumulations of alumina building up along the sides of the potshell.

In other words, this design of potshell results in high and stable heat transfer figures between the shell sides and the surroundings. This is of very great importance in the formation of a strong and stable side freeze which in turn protects the side lining.

Stable side freeze results in a stable and favorable cathodic current distribution, and thus good operating conditions. Good operating conditions give higher current efficiency and longer cathode life.

BRIEF DESCRIPTION OF THE DRAWINGS

The invention is described below in more detail with reference to the drawings, in which.

DETAILED DESCRIPTION OF THE INVENTION

Figure 1:
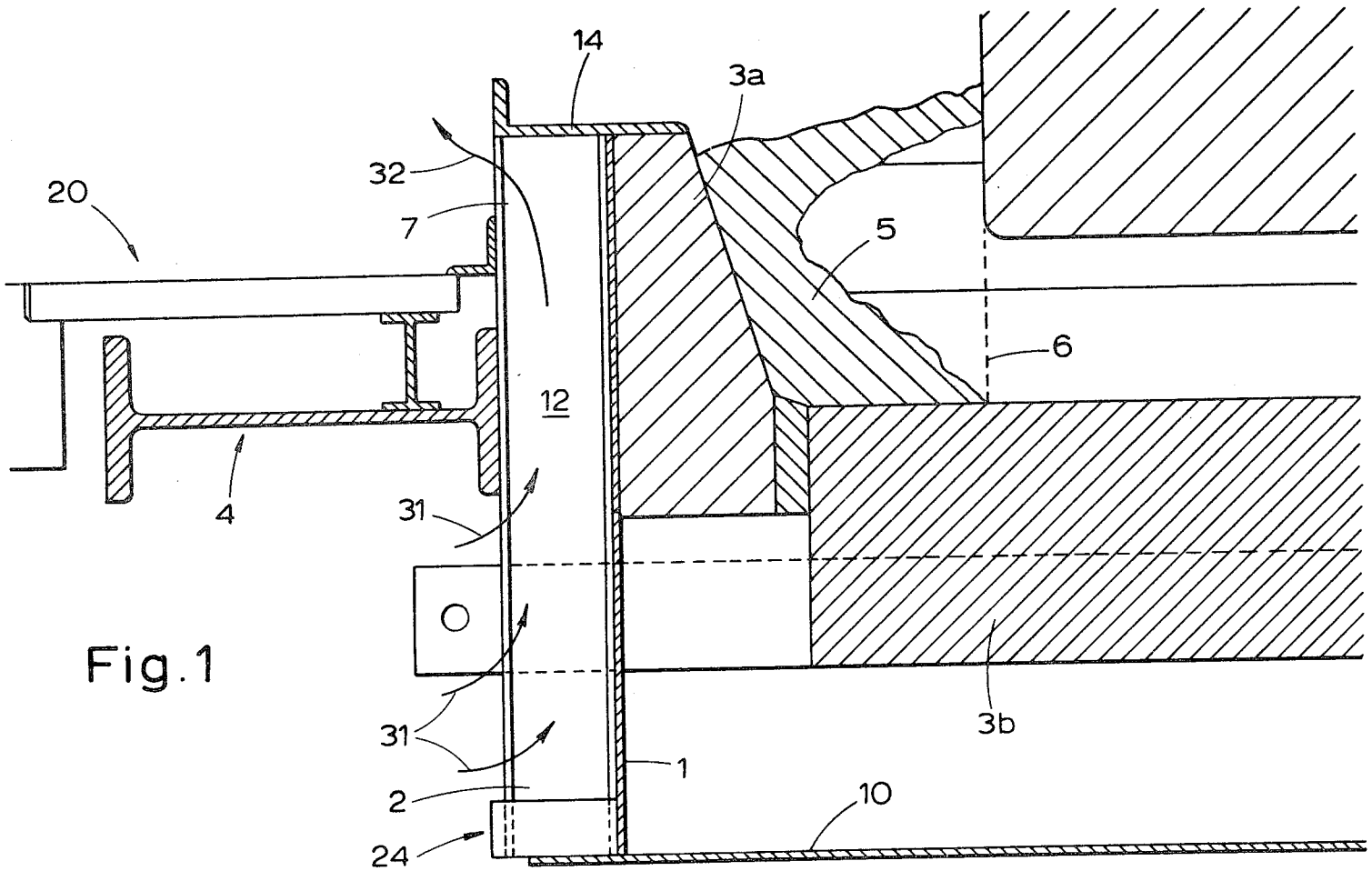
FIG. 1 is a vertical section through a part of an electrolytic cell.

The figures show side walls 1 and end walls 11 which, together with a bottom plate 10, form the potshell proper, built of steel plates. The steel walls 1 and 11 require a strong peripheral reinforcement which, in this case, primarily consists of vertical stiffeners 2 along the side walls 1 and corresponding stiffeners 22 along the end walls 11. These stiffeners act as vertical cooling ribs which serve to transfer the heat from the walls of the potshell to the air currents flowing along the outside. Stiffeners 2 and 22 can expediently be made of I-sections or T-sections in order better to be able to resist the powerful expansion forces from the lining 3*a* and 3*b* of the pot, as shown in FIG. 1.

Outside the stiffeners 2 and 22 there is disposed a reinforcing frame 4 consisting of strong steel girders 41 and 42, extending horizontally along the side walls and the end walls of the structure, respectively. This reinforcing frame 4 should preferably run, unbroken, around all the sides of the potshell, and can be arranged to be divided in two by means of a fish plate connection 44 or the like in the middle at each end.

Through this design, vertical air passages 12 are formed between the stiffeners 2 along the side walls 1, and also corresponding vertical air passages 13 between the stiffeners 22 along the end walls 11. As may be seen, particularly in FIG. 1, the potshell is designed to be installed such that air enters into the air passages, for example passage 12 in FIG. 1, from the potrooms basement under the floor 20, as indicated by arrows 31, and flows out into the potroom, over the floor 20, from the upper end of the air passages 12, as indicated by arrow 32. In this manner use is made of the draught which is caused by the usual fan exhaust arrangement found in such potrooms. A particular advantage in this conection is that the temperature in the basement is usually lower than in the potroom itself, so that the air which flows through the air passages 12 and 13 is comparatively cold.

The opening or slot 7 through which the air exits at the upper end of each air passage, can expediently be adjustable in order to make it possible to vary the cooling effect.

In connection with this invention it is important that no horizontal reinforcing elements be disposed along the walls of the shell which could obstruct the vertical circulation described or which could cause there to be built up a heat-insulating layer of alumina or other dust. The positioning of the most important and the most heavily stressed load-bearing element, namely the reinforcing frame 4, outside the stiffeners 2 and 22 also has the result that this reinforcing frame acquires a lower temperature, and is subjected to only small temperature variations as the ambient temperature varies. In this manner the danger of ageing phenomena in the reinforcing frame is heavily reduced.

In order to prevent the accumulation of alumina or dust in the air passages 12 and 13, there can be disposed, as shown in FIG. 1, a roof or cover 14, in the form of a plate or section, which forces the air current 32 to exit sideways from air passage 12.

Experience has shown that, when the number of cooling ribs in the form of the above described stiffeners has been correctly chosen and when the surfaces of the cooling ribs are correcty dimensioned, it is possible to achieve the result that the side freeze 5, as shown in FIG. 1, extends approximately into the shadow of the anode 6. This is considered to be the ideal situation as it reduces the horizontal current components to a minimum without reducing, too heavily, the effective cathode area. Depending upon the time of the year or the ambient temperature, the size of the slot 7 can be varied in order to thereby adjust the thickness of the side freeze 5.

As may be seen from FIG. 1, the stiffeners are supported on base blocks 24, for example by wedging, so that lateral forces can be transferred between the bottom end of the stiffeners and the bottom plate 10 of the potshell. In this embodiment the stiffeners are neither welded nor bolted to the potshell walls but are loose and can easily be removed and, for example, straightened, should this be necessary. The reinforcing frame 4 is also easily dismantled, for example for straightening in the event of misalignment having occurred. In connection with the above-mentioned anchoring of the lower end of the stiffeners it is important that the reinforcing frame 4 be positioned comparatively far up along the sides of the shell walls, and at least on a level with the top of the carbon cathode **3*b*. In this way one takes better advantage of the tensile strength of the bottom plate 10**.

In addition to the above-mentioned advantages with respect to thermal conditions and mechanical strength, the embodiment described according to the invention is also advantageous inasmuch as it is simple and rational to produce. For example, the need for machine tools is minimal. Except for welding, no skilled labor is required. Further, it is not of umimportance that the structure described makes it simple and cheap to carry out maintenance and repairs, in the event, for example, of the complete or partial dismantling of the electrolytic cell.

Finally, on the question of the thermal conditions, it must be added that the new potshell design of the invention results in a very stable side freeze. Furthermore, it has a very stable heat balance, i.e., it can be regarded as "self regulating." In practice, this new potshell design has proved to suffer very rarely from leakage through penetration of the side lining. This is an advantage of very great importance as explained above. The improved horizontal dissipation of heat through the side walls of the potshell also results in a more favorable ratio between heat loss through the sides and through the bottom, respectively, in that a simultaneously improved bottom insulation, working in co-operation with the good cooling of the side and end walls, produces a side freeze which has the right configuration and which is more stable than that which forms in previously known types of potshell. This improves and stabilizes the current distribution in the metal in the electrolytic cell.

It will be understood that the design and construction described above can be modified in various ways within the scope of this invention, for example, through some other dividing up of the reinforcing frame, through the use of stiffeners of different sectional geometry than those mentioned by way of example, and other methods of joining the main components of the potshell, etc.

Figure 2:
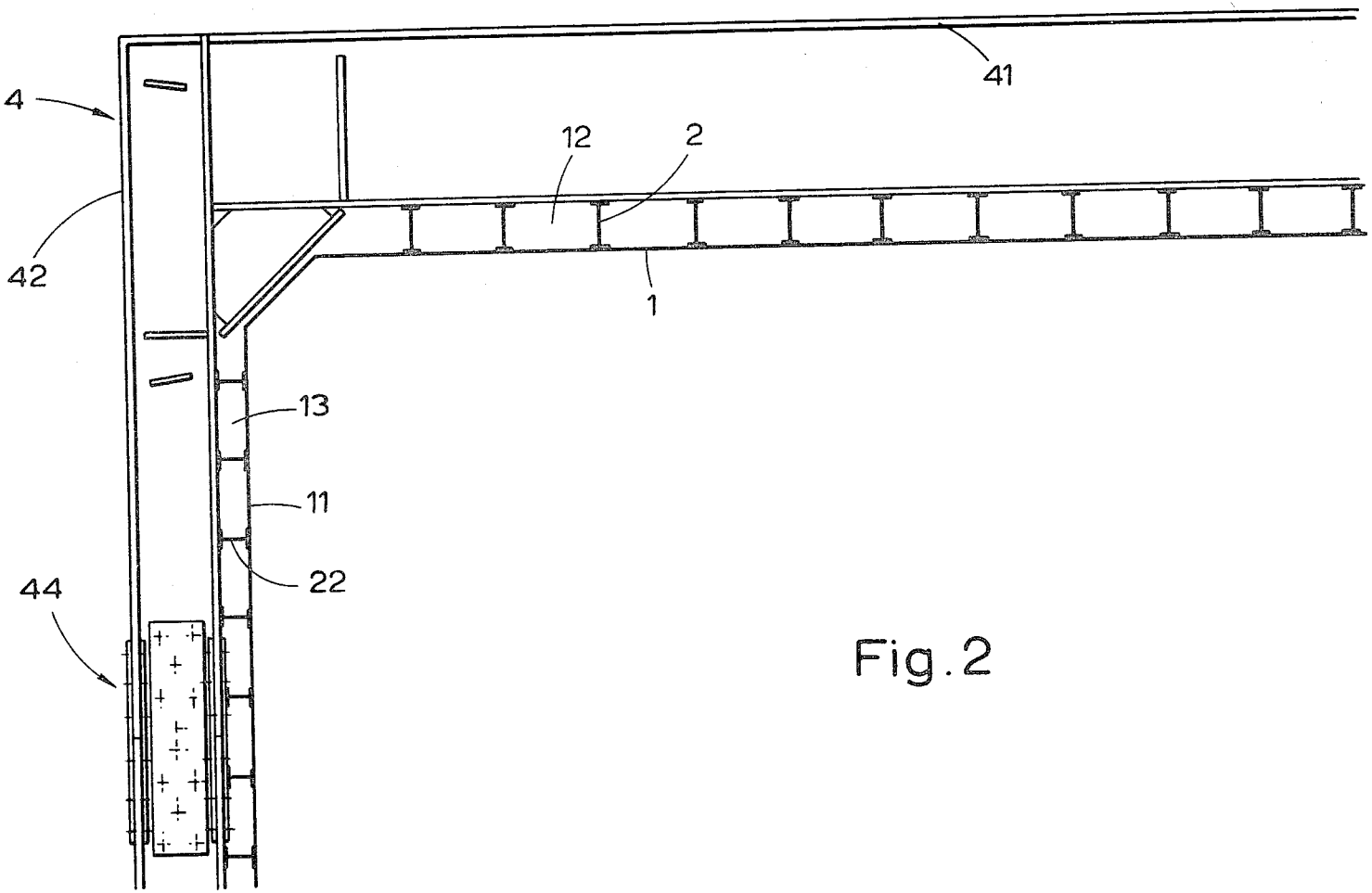
FIG. 2 is a horizontal section through a part of an electrolytic cell on a somewhat smaller scale.
Figure 3:
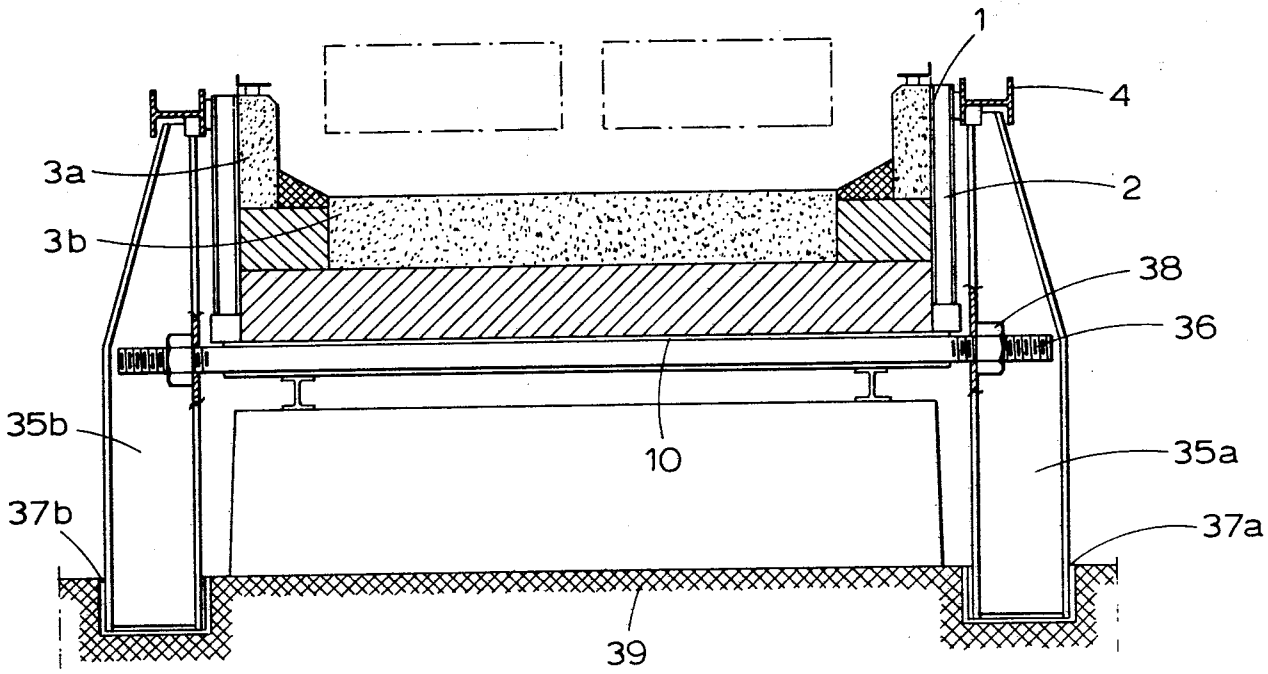
FIG. 3 is a vertical section through an electrolytic cell having a transverse reinforcement arrangement.

In the embodiment shown in FIG. 3, reference numerals corresponding to those found in FIGS. 1 and 2 are used to identify the following: side walls 1, vertical stiffeners 2, pot linings **3*a* and 3*b*, reinforcing frame 4 and bottom plate 10**.

As an additional reinforcement this embodiment has vertical beams **35*a* and 35*b* on either side of the potshell, being welded or otherwise secured at their upper ends to the frame 4. At their lower ends beams 35*a* and 35*b* are anchored in recesses 37*a* and 37*b*, respectively, in the basement floor 39. Intermediate their ends beams 35*a* and 35*b* are connected to each other by means of transverse rods 36 having nuts 38 threaded at their ends for connection to the beams 35*a* and 35*b*. This reinforcement makes it possible to reduce the dimensions of the members forming the frame 4 since transverse forces to a large extent will be taken up by the rods 36 and the floor 39. Smaller dimensions of the frame 4** in turn will reduce the space requirement for each pot.

We claim:

1. A potshell for an electrolytic cell for the electrolytic reduction of aluminum, said potshell comprising a bottom plate, side walls and end walls formed of steel plates; vertical stiffeners disposed against the exterior of the side walls; an essentially horizontal reinforcing frame disposed exterior of and surrounding said stiffeners; vertical, free air passages being provided between said stiffeners up against the side walls and the end walls; and said stiffeners acting as cooling ribs for conducting and dissipating the heat from the side walls and the end walls.

2. Potshell according to claim 1, characterized in that it is designed for installation in a potroom in such a manner that the lower parts of said air passages are below the floor of the potroom, while the other ends of said air passages are above the floor.

3. Potshell according to claim 2, wherein the upper ends of said air passages are equipped with an adjustable slot or opening.

4. Potshell according to claim 2, further comprising a roof or cover at the upper ends of the air passages, so that air currents leave said passages in a lateral direction.

5. Potshell according to claim 1, wherein said stiffeners at the lower ends thereof are connected with said bottom plate, and said reinforcing frame is positioned at least as high as the top of the carbon cathode of a cell.

6. Potshell according to claim 1, wherein said reinforcing frame surrounds all of said side walls and end walls and is arranged to be able to be divided into at least two parts.

7. Potshell according to claim 1, wherein said vertical stiffeners are not permanently fixed, for example neither welded nor bolted, to said side walls or said end walls.

8. Potshell according to claim 1, wherein said vertical stiffeners are in the form of steel sections, for example I-sections or T-sections.

9. Potshell according to claim 1, further comprising vertical beams positioned along said side walls, upper ends of said beams being secured to the frame, lower ends of said beams being anchored in recesses in the basement floor, and transverse rods beneath the bottom plate inter-connecting the intermediate portions of corresponding beams with each other.

* * * * *